US008511319B2

(12) United States Patent
Sears et al.

(10) Patent No.: US 8,511,319 B2
(45) Date of Patent: Aug. 20, 2013

(54) ADSORBENT MATERIAL IMPREGNATED WITH METAL OXIDE COMPONENT

(75) Inventors: Stephen Benson Sears, Siler City, NC (US); Chandra Kumar Banerjee, Clemmons, NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 354 days.

(21) Appl. No.: 12/274,818

(22) Filed: Nov. 20, 2008

(65) Prior Publication Data

US 2010/0122708 A1 May 20, 2010

(51) Int. Cl.
*A24B 15/18* (2006.01)

(52) U.S. Cl.
USPC ..... 131/334; 131/207; 131/202

(58) Field of Classification Search
USPC ..... 131/202, 207, 334, 344
See application file for complete search history.

(56) References Cited

U.S. PATENT DOCUMENTS

| | | | | |
|---|---|---|---|---|
| 2,881,770 | A | 4/1959 | Touey | |
| 3,101,723 | A | 8/1963 | Seligman | |
| 3,217,715 | A | 11/1965 | Berger et al. | |
| 3,236,244 | A | 2/1966 | Irby et al. | |
| 3,311,519 | A | 3/1967 | Touey et al. | |
| 3,313,306 | A | 4/1967 | Berger | |
| 3,347,247 | A | 10/1967 | Lloyd | |
| 3,349,780 | A | 10/1967 | Sublett et al. | |
| 3,355,317 | A * | 11/1967 | Keith et al. | 427/215 |
| 3,370,595 | A | 2/1968 | Davis et al. | |
| 3,413,982 | A | 12/1968 | Sublett et al. | |
| 3,551,256 | A | 12/1970 | Watson | |
| 3,602,231 | A | 8/1971 | Dock | |
| 3,648,711 | A | 3/1972 | Berger et al. | |
| 3,957,563 | A | 5/1976 | Sexstone et al. | |
| 3,972,335 | A | 8/1976 | Tiggelbeck et al. | |
| 4,174,720 | A | 11/1979 | Hall | |
| 4,201,234 | A | 5/1980 | Neukomm | |
| 4,223,597 | A | 9/1980 | Lebet | |
| 4,317,460 | A * | 3/1982 | Dale et al. | 131/334 |
| 4,771,795 | A | 9/1988 | White et al. | |
| 5,027,837 | A | 7/1991 | Clearman et al. | |
| 5,076,296 | A | 12/1991 | Nystrom et al. | |
| 5,137,034 | A | 8/1992 | Perfetti et al. | |
| 5,188,130 | A | 2/1993 | Hajaligol et al. | |
| 5,360,023 | A | 11/1994 | Blakley et al. | |
| 5,443,560 | A | 8/1995 | Deevi et al. | |
| 5,468,266 | A | 11/1995 | Bensalem et al. | |
| 5,568,819 | A | 10/1996 | Gentry et al. | |
| 5,595,577 | A | 1/1997 | Bensalem et al. | |
| 5,622,190 | A | 4/1997 | Arterbery et al. | |
| 5,909,736 | A | 6/1999 | Stavridis | |
| 6,503,475 | B1 | 1/2003 | McCormick et al. | |
| 6,537,186 | B1 | 3/2003 | Veluz | |
| 6,584,979 | B2 | 7/2003 | Xue et al. | |
| 6,761,174 | B2 | 7/2004 | Jupe et al. | |
| 6,789,547 | B1 | 9/2004 | Paine, III | |
| 6,789,548 | B2 | 9/2004 | Bereman | |
| 7,011,096 | B2 | 3/2006 | Li et al. | |
| 7,049,382 | B2 | 5/2006 | Haftka et al. | |
| 7,237,558 | B2 | 7/2007 | Clark et al. | |
| 7,370,657 | B2 | 5/2008 | Zhuang et al. | |
| 7,569,510 | B2 | 8/2009 | Deevi et al. | |
| 7,833,316 | B2 * | 11/2010 | Tatarchuck et al. | 95/135 |
| 2002/0014453 | A1 | 2/2002 | Lilly, Jr. et al. | |
| 2002/0020420 | A1 | 2/2002 | Xue et al. | |
| 2002/0166563 | A1 | 11/2002 | Jupe et al. | |
| 2002/0167118 | A1 | 11/2002 | Billiet et al. | |
| 2002/0172826 | A1 | 11/2002 | Yadav et al. | |
| 2002/0194958 | A1 | 12/2002 | Lee et al. | |
| 2003/0000538 | A1 | 1/2003 | Beremanet et al. | |
| 2003/0034085 | A1 | 2/2003 | Spiers et al. | |
| 2003/0106562 | A1 | 6/2003 | Chatterjee | |
| 2003/0154993 | A1 | 8/2003 | Paine et al. | |

(Continued)

FOREIGN PATENT DOCUMENTS

| | | |
|---|---|---|
| EP | 236992 | 9/1987 |
| EP | 419733 | 4/1991 |

(Continued)

OTHER PUBLICATIONS

Shen et al., Preparation of Mesoporous Caron From Commercial Activated Carbon with Steam Activation in the Presence of Cerium Oxide, "*Journal of Colloid and Interface Science*" 2003, pp. 467-473, vol. 264.

(Continued)

*Primary Examiner* — Richard Crispino
*Assistant Examiner* — Dionne Walls Mayes
(74) *Attorney, Agent, or Firm* — Womble Carlyle Sandridge & Rice, LLP

(57) ABSTRACT

The invention provides a modified adsorbent material impregnated with a metal oxide, which can be used in a filter element adapted for use in a smoking article. The modified adsorbent material exhibits increased filtration efficiency with respect to certain gas phase species of mainstream cigarette smoke. Exemplary adsorbent materials that can be modified according to the invention include activated carbon, molecular sieves, clays, ion exchange resins, activated aluminas, silica gels, meerschaum, and mixtures thereof. One example of a metal oxide is cerium oxide. Impregnation with a metal oxide can be accomplished by directly treating the adsorbent with a metal oxide or impregnating the adsorbent with a metal oxide precursor, such as cerium nitrate, followed by calcining the impregnated material to convert the precursor to the desired metal oxide. Methods of forming the modified adsorbent material and smoking article filters incorporating the modified adsorbent material are also provided.

18 Claims, 2 Drawing Sheets

(56) References Cited

U.S. PATENT DOCUMENTS

| | | | | |
|---|---|---|---|---|
| 2003/0168070 | A1 | 9/2003 | Xue et al. | |
| 2003/0200973 | A1 | 10/2003 | Xue et al. | |
| 2004/0194792 | A1 | 10/2004 | Zhuang et al. | |
| 2004/0226569 | A1 | 11/2004 | Yang et al. | |
| 2004/0237984 | A1 | 12/2004 | Figlar et al. | |
| 2004/0250827 | A1 | 12/2004 | Deevi et al. | |
| 2005/0049128 | A1 | 3/2005 | Buhl et al. | |
| 2005/0066984 | A1 | 3/2005 | Crooks et al. | |
| 2005/0133051 | A1 | 6/2005 | Luan et al. | |
| 2005/0166935 | A1 | 8/2005 | Reddy et al. | |
| 2005/0274390 | A1 | 12/2005 | Banerjee et al. | |
| 2006/0025292 | A1 | 2/2006 | Hicks et al. | |
| 2006/0144410 | A1 | 7/2006 | Luan et al. | |
| 2006/0180164 | A1 | 8/2006 | Paine, III et al. | |
| 2006/0225753 | A1 | 10/2006 | Kaczmarek et al. | |
| 2007/0056600 | A1 | 3/2007 | Coleman, III et al. | |
| 2007/0204870 | A1* | 9/2007 | Deevi et al. | 131/331 |
| 2007/0215168 | A1 | 9/2007 | Banerjee et al. | |
| 2007/0251658 | A1 | 11/2007 | Gedevanishvili et al. | |
| 2008/0092912 | A1 | 4/2008 | Robinson et al. | |
| 2009/0186953 | A1* | 7/2009 | Gesenhues et al. | 518/728 |

FOREIGN PATENT DOCUMENTS

| | | |
|---|---|---|
| EP | 419981 | 4/1991 |
| EP | 579410 | 1/1994 |
| EP | 913100 | 10/1997 |
| WO | WO 03/059096 | 7/2003 |
| WO | WO 2005/023026 | 3/2005 |
| WO | WO 2006/051422 | 5/2006 |
| WO | WO 2006/064371 | 6/2006 |
| WO | WO 2006/103404 | 10/2006 |
| WO | WO 2007/104908 | 9/2007 |
| WO | WO 2008/043982 | 4/2008 |
| WO | WO 2008/043983 | 4/2008 |

OTHER PUBLICATIONS

Tamai et al., "Synthesis of Extremely Large Mesoporous Activated Carbon and its Unique Adsorption for Giant Molecules," *Chem. Mater*, 1996, pp. 454-462, vol. 8.

* cited by examiner

ADSORBENT MATERIAL IMPREGNATED WITH METAL OXIDE COMPONENT

BACKGROUND OF THE INVENTION

1. Field of the Invention

The invention relates to adsorbent materials useful as filtration media, as well as smoking article filters comprising adsorbent materials.

2. Description of Related Art

Popular smoking articles, such as cigarettes, have a substantially cylindrical rod shaped structure and include a charge, roll or column of smokable material, such as shredded tobacco (e.g., in cut filler form), surrounded by a paper wrapper, thereby forming a so-called "smokable rod" or "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Certain filter elements can incorporate polyhydric alcohols. Typically, the filter element is attached to one end of the tobacco rod using a circumscribing wrapping material known as "tipping paper." Descriptions of cigarettes and the various components thereof are set forth in Tobacco Production, Chemistry and Technology, Davis et al. (Eds.) (1999). A cigarette is employed by a smoker by lighting one end thereof and burning the tobacco rod. The smoker then receives mainstream smoke into his/her mouth by drawing on the opposite end (e.g., the filter end) of the cigarette.

Certain cigarettes incorporate filter elements having adsorbent materials dispersed therein, such as activated carbon or charcoal materials (collectively, carbonaceous materials) in particulate or granular form. For example, an exemplary cigarette filter can possess multiple segments, and at least one of those segments can comprise particles of high carbon-content materials. Granules of carbonaceous material can be incorporated into "dalmation" types of filter regions using the general types of techniques used for traditional dalmation filter manufacture. Techniques for production of dalmation filters are known, and representative dalmation filters have been provided commercially by Filtrona Greensboro Inc. Alternatively, granules of carbonaceous material can be incorporated into "cavity" types of filter regions using the general types of techniques used for traditional "cavity" filter manufacture. Various types of filters incorporating charcoal particles or activated carbon types of materials are set forth in U.S. Pat. Nos. 2,881,770 to Touey; 3,101,723 to Seligman et al.; 3,236,244 to Irby et al.; 3,311,519 to Touey et al.; 3,313,306 to Berger; 3,347,247 to Lloyd; 3,349,780 to Sublett et al.; 3,370,595 to Davis et al.; 3,413,982 to Sublett et al.; 3,551,256 to Watson; 3,602,231 to Dock; 3,972,335 to Tigglebeck et al.; 5,360,023 to Blakley et al.; 5,909,736 to Stavridis; and 6,537,186 to Veluz; U.S. Pat. Publication Nos. 2003/00340085 to Spiers et al.; 2003/0106562 to Chatterjee; 2006/0025292 to Hicks et al.; and 2007/0056600 to Coleman, III et al.; PCT WO 2006/064371 to Banerjea et al. PCT WO 2006/051422 to Jupe et al.; and PCT WO2006/103404 to Cashmore et al., which are incorporated herein by reference.

It would be highly desirable to provide a cigarette possessing a filter element incorporating an adsorbent material, wherein the filter element possesses the ability to alter the character or nature of mainstream smoke passing through the filter element.

SUMMARY OF THE INVENTION

The invention provides a method of increasing the mesopore volume of a porous adsorbent material by impregnating the adsorbent with a metal oxide, which results in a modified adsorbent that can alter the character or nature of mainstream smoke passing through a cigarette filter containing the modified adsorbent, such as by enhancing adsorption of certain gas phase molecules. Adsorbents of the invention can be used in a variety of filtration applications, including filtration of mainstream smoke in smoking articles such as cigarettes.

In one aspect, the invention provides a filter element adapted for use in a smoking article, comprising a porous adsorbent material impregnated with a metal oxide. Exemplary adsorbents include activated carbon, molecular sieves, clays, ion exchange resins, activated aluminas, silica gels, meerschaum, and mixtures thereof. The modified adsorbent material can be used as filtration media in a variety of forms, including powdered, granular, particulate, fibrous, and monolithic.

The metal of the metal oxide is selected from the group consisting of alkali metals, alkaline earth metals, transition metals in Groups IIIB, IVB, VB, VIB VIIB, VIIIB, IB, and IIB, Group IIIA elements, Group IVA elements, lanthanides, and actinides. Typical examples of the metal of the metal oxide include iron, copper, cerium, manganese, magnesium, and zinc. The metal oxide precursor is typically in the form of a metal salt or an organic metal compound capable of thermal decomposition to form a metal oxide. A preferred metal oxide is cerium oxide.

The amount of metal oxide impregnated into the porous adsorbent material can vary depending on the desired characteristics of the adsorbent material. The amount of metal oxide present within the adsorbent is typically at least about 2 weight percent, based on the total weigh of the metal oxide and the adsorbent, often at least about 5 weight percent, and most often at least about 10 weight percent. In one embodiment, the porous adsorbent material comprises an amount of metal oxide sufficient to increase the mesopore volume of the adsorbent material by at least 25%.

In another aspect, the invention provides a method of preparing a filter element for a smoking article, comprising (i) impregnating a porous adsorbent material with a metal oxide or metal oxide precursor to form an impregnated adsorbent material; (ii) if step (i) results in impregnation with a metal oxide precursor, calcining the impregnated adsorbent material for a time and at a temperature sufficient to convert the metal oxide precursor to the corresponding metal oxide in order to provide a porous adsorbent material impregnated with metal oxide; and (iii) incorporating the porous adsorbent material impregnated with metal oxide into a smoking article filter element. The impregnating step can be accomplished by, for example, treating the porous adsorbent material with a liquid composition comprising a liquid carrier (e.g., water) and a metal oxide or metal oxide precursor.

In yet another aspect of the invention, a cigarette filter comprising the modified adsorbent of the invention is provided, such as a cigarette filter comprising a cavity positioned between two sections of fibrous filter material, the adsorbent positioned within the cavity and in granular form. Alternatively, at least one section of fibrous filter material of the cigarette filter can include the modified adsorbent, in granular form, imbedded in the fibrous filter material. Smoking articles including the filter incorporating the modified adsorbent material are also provided.

14. A filter element adapted for use in a smoking article, comprising a porous adsorbent material impregnated with at least about 2 weight percent of a metal oxide, the adsorbent material having a total mesopore volume of at least about 0.1 cc/g and a mesopore volume percentage of at least 30%.

BRIEF DESCRIPTION OF THE DRAWINGS

In order to assist the understanding of embodiments of the invention, reference will now be made to the appended drawings, which are not necessarily drawn to scale. The drawings are exemplary only, and should not be construed as limiting the invention.

DETAILED DESCRIPTION OF THE PREFERRED EMBODIMENTS

Figure 1:
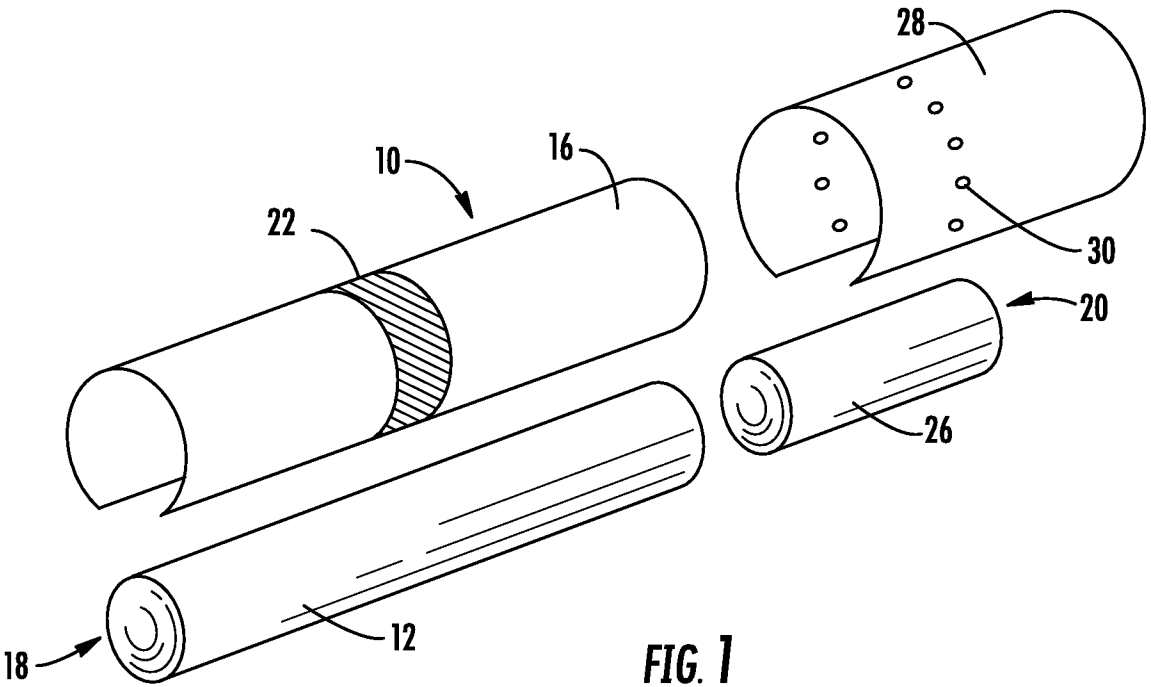
FIG. 1 is an exploded perspective view of a smoking article having the form of a cigarette, showing the smokable material, the wrapping material components, and the filter element of the cigarette.

The present inventions will now be described more fully hereinafter with reference to the accompanying drawings. The invention may be embodied in many different forms and should not be construed as limited to the embodiments set forth herein; rather, these embodiments are provided so that this disclosure will satisfy applicable legal requirements. Like numbers refer to like elements throughout. As used in this specification and the claims, the singular forms "a," "an," and "the" include plural referents unless the context clearly dictates otherwise.

The invention provides modified, porous adsorbent materials that exhibit enhanced filtration efficiency with respect to certain gas phase species of mainstream cigarette smoke. The porous adsorbent material of the invention is impregnated with a metal oxide. The porous adsorbent material can be impregnated directly with the metal oxide material or impregnated with a metal oxide precursor material that is subsequently calcined to produce the desired metal oxide.

The presence of the metal oxide within the pores of the adsorbent material is believed to enhance gas phase filtration of certain molecules due, at least in part, to changes in the distribution of pore size within the adsorbent material. Impregnation of a porous adsorbent material with a metal oxide results in an increase in mesopore volume and a decrease in macropore volume, as well as increase in BET surface area.

The term "mesopore" is used herein in a manner consistent with IUPAC classification, meaning pores with a width between 2 nm and 50 nm. Macropores are any pores having a width larger than 50 nm. Micropores have a pore width of less than 2 nm. See, J Rouquerol, et al. (1994) Pure Appl. Chem., 66, 1976. Surprisingly, it has been discovered that increasing mesopore volume increases the efficiency of adsorption of a wide variety of gas phase molecules, even relatively small molecules.

The effect of the metal oxide loading on total BET surface area and BET surface area distribution based on pore size will vary depending on the amount of metal oxide used, the type and BET surface area characteristics of the unmodified adsorbent material, and the like. However, adsorbent materials impregnated according to the invention typically have a total mesopore volume of at least about 0.1 cc/g, more often at least about 0.2 cc/g, and most often at least about 0.3 cc/g. Typically, the total mesopore volume is less than about 2.0 cc/g, often less than about 1.0 cc/g, and most often less than about 0.7 cc/g. The modified adsorbent materials typically have a volume percentage of total pores present as mesopores of at least about 30%, more often at least about 40%, and most often at least about 50%. Typically, the mesopore volume percentage is less than about 95%, often less than about 90%, and most often less than about 85%. An exemplary range of mesopore percentage is about 60% to about 95%, more often about 80% to about 90%.

Impregnation of an adsorbent material with metal oxide also results in an increase in total BET surface area. Adsorbent materials impregnated according to the invention typically have a total BET surface area of at least about 200 $m^2/g$, often at least about 250 $m^2/g$, and most often at least about 300 $m^2/g$. The ranges of surface area and mesopore volume strongly depend upon the class of adsorbent material, e.g., activated carbon, zeolites, or activated aluminas. Ranges also depend on the type of metal oxide treatment. In general, a single treatment with a single metal oxide or metal oxide precursor yields at least about 25% increase in mesopore volume and mesopore surface area. The treatment can be repeated if additional increases are desired. Pore volumes (total, macro, meso, and micro) and surface area (total, macro, meso, and micro) can be determined using the Brunauer, Emmet and Teller (BET) method described in *J. Amer. Chem. Soc., Vol.* 60(2), pp. 309-319 (1938).

The metal oxide or metal oxide precursor coated onto the porous adsorbent material may vary. Certain exemplary metal oxides are metal-containing compounds capable of either directly reacting with one or more gas phase components of mainstream smoke generated by a smoking article or catalyzing a reaction involving a gas phase component of mainstream smoke or both. In US 2007/0215168 to Banerjee et al., which is incorporated by reference herein in its entirety, the use of cerium oxide is described. Additional metal-containing compounds are described in U.S. Pat. Nos. 6,503,475 to McCormick; 6,503,475 to McCormick, and 7,011,096 to Li et al.; and US Pat. Publication Nos. 2002/0167118 to Billiet et al.; 2002/0172826 to Yadav et al.; 2002/0194958 to Lee et al.; 2002/014453 to Lilly Jr., et al.; 2003/0000538 to Bereman et al.; and 2005/0274390 to Banerjee et al., which are also incorporated by reference herein in their entirety.

The metal oxide precursor can be any precursor compound that thermally decomposes to form a metal oxide. Exemplary catalyst precursors include metal salts (e.g., metal citrates, hydrides, thiolates, amides, nitrates, ammonium nitrates, carbonates, cyanates, sulfates, bromides, chlorides, as well as hydrates thereof) and metal organic compounds comprising a metal atom bonded to an organic radical (e.g., acetates, alkoxides, β-diketonates, carboxylates and oxalates). US 2007/0251658 to Gedevanishvili et al., which is incorporated by reference herein in its entirety, discloses a variety of catalyst precursors that can be used in the invention.

Examples of the metal component of the metal oxide or metal oxide precursor compound include, but are not limited to, alkali metals, alkaline earth metals, transition metals in Groups IIIB, IVB, VB, VIB VIIB, VIIIB, IB, and IIB, Group IIIA elements, Group IVA elements, lanthanides, and actinides. Specific exemplary metal elements include Ti, Zr, Hf, V, Nb, Ta, Cr, Mo, W, Mn, Re, Fe, Co, Ni, Ru, Rh, Pd, Os, Ir, Pt, Cu, Ag, Au, Zn, Y, Ce, Na, K, Cs, Mg, Ca, B, Al, Si, Ge, and Sn.

Examples of metal oxide compounds useful in the invention include iron oxides, copper oxide, zinc oxide, and cerium oxide. Exemplary metal oxide precursors include iron nitrate, copper nitrate, cerium nitrate, cerium ammonium nitrate, manganese nitrate, magnesium nitrate, zinc nitrate, and the hydrates thereof. Combinations of multiple metal oxides and/or metal oxide precursors could be used. The particle size of the metal oxide or metal oxide precursor compounds can vary, but is typically between about 1 nm to about 1 micron.

The amount of metal oxide or metal oxide precursor that is applied to the adsorbent material can vary and will depend, for example, on the surface area and pore size characteristics desired for the modified adsorbent material. The amount of metal oxide or metal oxide precursor used should be sufficient to provide a final metal oxide content that increases the BET surface area and the mesopore volume of the adsorbent material. The desired enhancement of mesopore surface area and volume can be achieved by a single treatment of metal oxide and/or metal oxide precursor or by multiple treatments of metal oxide and/or metal oxide precursor. Typically, the amount of metal oxide or metal oxide precursor added to the adsorbent can be expressed as at least about 2 weight percent, based on the total weight of the metal oxide or precursor and the adsorbent material, generally at least about 5% or at least about 10%, more often at least about 30%, and most often at least about 40% or at least about 50%. The amount of metal oxide or precursor is typically less than about 99 weight percent, often less than about 80%, and most often less than about 60%.

The porous adsorbent material can be any adsorbent material having a relatively high surface area capable of adsorbing smoke constituents with or without a high degree of specificity. Types of adsorbent materials include carbonaceous materials (e.g., activated carbon), molecular sieves (e.g., zeolites and carbon molecular sieves), clays, ion exchange resins, activated aluminas, silica gels, meerschaum, and mixtures thereof. Any adsorbent material, or mixture of materials, that has the ability to alter the character or nature of mainstream smoke passing through a smoking article filter element could be used without departing from the invention. If the adsorbent material is not inherently porous, the adsorbent can be treated to increase porosity using methods known in the art.

Exemplary metal oxide (alumina and titania) adsorbent materials have surface areas, prior to modification according to the invention, of more than about 50 $m^2/g$, often more than about 100 $m^2/g$, and frequently more than about 150 $m^2/g$, as determined using the BET method. Exemplary activated carbons, prior to modification, have surface areas of more than about 800 $m^2/g$, often more than about 1200 $m^2/g$, and frequently more than about 1300 $m^2/g$.

Exemplary carbonaceous materials for use as adsorbents can be derived from synthetic or natural sources. Materials such as rayon or nylon can be carbonized, followed by treatment with oxygen to provide activated carbonaceous materials. Materials such as wood and coconut shells can be carbonized, followed by treatment with oxygen to provide activated carbonaceous materials. Preferred carbonaceous materials are provided by carbonizing or pyrolyzing bituminous coal, tobacco material, softwood pulp, hardwood pulp, coconut shells, almond shells, grape seeds, walnut shells, macadamia shells, kapok fibers, cotton fibers, cotton linters, and the like. Examples of suitable carbonaceous materials are activated coconut hull based carbons available from Calgon Corp. as PCB and GRC-11 or from PICA as G277, coal-based carbons available from Calgon Corp. as S-Sorb, Sorbite, BPL, CRC-11F, FCA and SGL, wood-based carbons available from Westvaco as WV-B, SA-20 and BSA-20, carbonaceous materials available from Calgon Corp. as HMC, ASC/GR-1 and SC II, Witco Carbon No. 637, AMBERSORB 572 or AMBERSORB 563 resins available from Rohm and Haas, and various activated carbon materials available from Prominent Systems, Inc. Other carbonaceous materials are described in U.S. Pat. Nos. 4,771,795 to White, et al. and 5,027,837 to Clearman, et al.; and European Patent Application Nos. 236,922; 419,733 and 419,981.

Preferred carbonaceous materials are coconut shell types of activated carbons available from sources such as Calgon Carbon Corporation, Gowrishankar Chemicals, Carbon Activated Corp. and General Carbon Corp. Typically, the carbon has an activity of about 60 to about 150 Carbon Tetrachloride Activity (i.e., weight percent pickup of carbon tetrachloride). See, also, for example, Activated Carbon Compendium, Marsh (Ed.) (2001), which is incorporated herein by reference.

Certain carbonaceous materials can be impregnated with substances, such as transition metals (e.g., silver, gold, copper, platinum, and palladium), potassium bicarbonate, tobacco extracts, polyethyleneimine, manganese dioxide, eugenol, and 4-ketononanoic acid. The carbon composition may also include one or more fillers, such as semolina. Grape seed extracts may also be incorporated into the carbonaceous material as a free radical scavenger.

Various types of charcoals and activated carbon materials suitable for incorporation into cigarette filters, various other filter element component materials, various types of cigarette filter element configurations and formats, and various manners and methods for incorporating carbonaceous materials into cigarette filter elements, are set forth in U.S. Pat. Nos. 3,217,715 to Berger et al.; 3,648,711 to Berger et al.; 3,957,563 to Sexstone; 4,174,720 to Hall; 4,201,234 to Neukomm; 4,223,597 to Lebert; 5,137,034 to Perfetti et al.; 5,360,023 to Blakley et al.; 5,568,819 to Gentry et al.; 5,622,190 to Arterbery et al.; 6,537,186 to Veluz; 6,584,979 to Xue et al.; 6,761,174 to Jupe et al.; 6,789,547 to Paine III; 6,789,548 to Bereman; and 7,370,657 to Zhuang et al.; US Pat. Appl. Pub. Nos. 2002/0166563 to Jupe et al.; 2002/0020420 to Xue et al.; 2003/0200973 to Xue et al.; 2003/0154993 to Paine et al.; 2003/0168070 to Xue et al.; 2004/0194792 to Zhuang et al.; 2004/0226569 to Yang et al.; 2004/0237984 to Figlar et al.; 2005/0133051 to Luan et al.; 2005/0049128 to Buhl et al.; 2005/0066984 to Crooks et al.; 2006/0144410 to Luan et al.; 2006/0180164 to Paine, III et al.; and 2007/0056600 to Coleman, III et al.; European Pat. Appl. 579410 to White; EP 913100 to Jung et al.; PCT WO2006/064371 to Banerjea et al., WO 2008/043982 to Tennison et al.; WO 2007/104908 to White et al.; WO 2006/103404 to Cashmore et al.; and WO 2005/023026 to Branton et al., which are incorporated herein by reference. Representative types of cigarettes possessing filter elements incorporating carbonaceous materials have been available as "Benson & Hedges Multifilter" by Philip Morris Inc., in the State of Florida during 2005 as a Philip Morris Inc. test market brand known as "Marlboro Ultra Smooth," and as "Mild Seven" by Japan Tobacco Inc. Sintered or foamed carbon materials (see, e.g., U.S. Pat. No. 7,049,382 to Haftka et al.) or gathered webs (see, e.g., US Pat. Appl. Pub. Nos. US 2008/0092912 to Robinson et al. and US 2007/0056600 to Coleman, III et al.) can also be used in the invention.

The adsorbent material is employed in a suitable form. For example, the adsorbent material can have a form that can be characterized as powdered, granular, fibrous, particulate, monolithic, or the like. Typical particle sizes are greater than about 10 Mesh, often greater than about 20 Mesh, and frequently greater than about 30 Mesh. Typical particle sizes are less than about 400 Mesh, often less than about 300 Mesh, and frequently less than about 200 Mesh. The terms "granular" and "particulate" are intended to encompass both non-spherical shaped particles and spherical particles, such as so-called "beaded carbon" described in PCT WO03/059096 A1, which is incorporated by reference herein.

The manner in which the metal oxide or metal oxide precursor (hereinafter collectively referred to as the "metal compound") is impregnated within the porous adsorbent material can vary. Any coating or impregnation technique that results in penetration of the metal oxide or metal oxide precursor into the pore volume of the adsorbent material can be used. Typically, the porous adsorbent is dip-coated or spray-coated with a liquid composition comprising a liquid carrier and the metal compound in particulate form (i.e., a suspension or solution). Examples of solvents that may be used as the liquid carrier include water (e.g., deionized water), pentanes, hexanes, cyclohexanes, xylenes, mineral spirits, alcohols (e.g., methanol, ethanol, propanol, isopropanol and butanol), and mixtures thereof. Stabilizers, such as acetic acid, nitric acid, sodium hydroxide, ammonium hydroxide, and certain other organic compounds, can be added to the suspension or solution. Alternatively, the metal compound could be applied to the surface of the porous adsorbent in dry powdered form, such as by agitation or vibration of the porous adsorbent in the presence of the powdered metal compound.

In order to promote uniform impregnation, the metal compound is typically dissolved in a volume of solvent equal to the pore volume of the adsorbent. The metal compound solution is thoroughly mixed with the adsorbent and allowed to impregnate in a vacuum chamber for about two hours at room temperature.

Following coating of the porous adsorbent material, if necessary, the coated material can be dried to remove excess solvent, such as by heating the coated material to a moderate temperature (e.g., 100-150° C.) for a time sufficient to effect the desired drying (e.g., about 1 to about 10 hours).

After the optional drying step, if the adsorbent material was impregnated with a metal oxide precursor, the coated material can be subjected to a calcining heat treatment to convert the precursor to the oxide form. As used herein, calcining refers to a thermal treatment process applied to a solid material in order to bring about a thermal decomposition and/or removal of a volatile fraction from the solid material. Alternatively, the adsorbent material can be used with the impregnated metal oxide precursor without converting the precursor to the corresponding oxide.

The duration and temperature of the calcining treatment can vary and is based, at least in part, on the decomposition temperature of the precursor. Typically, the calcining takes place at a temperature within the range of about 150° C. to about 600° C. In certain embodiments, the calcining treatment temperature is at least about 250° C., more often at least about 275° C., and most often at least about 300° C. However, the calcining treatment does not require extremely high temperature treatment. For example, the temperature can be characterized as lower than the temperature used for steam activation of activated carbon. Thus, the calcining temperature can be less than about 600° C., more often less than about 550° C., and most often less than about 500° C.

The length of the calcining treatment step can vary, but is typically between about 0.50 hour and about 24 hours, more often between about 1 hour and about 18 hours, and most often between about 2 hours and about 10 hours. The heat treatment step typically lasts for at least about 1 hour, more often at least about 1.5 hours, and most often at least about 2 hours.

The atmosphere exposed to the coated carbon material during calcination can vary, but is typically either air or an inert gas such as nitrogen, argon, and helium. The atmosphere during certain embodiments of the calcination process can be described as dry, meaning that the atmospheric moisture level during calcination is less than about 5 weight percent, based on the total weight of the headspace during calcination. Steam is not required in the method of the invention and certain embodiments of the calcining treatment can be described as conducted in the absence of steam.

Figure 2:
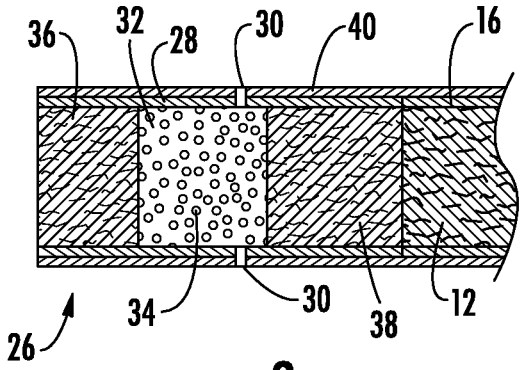
FIG. 2 is a cross-sectional view of a filter element incorporating an adsorbent material therein according to one embodiment of the present invention.
Figure 3:
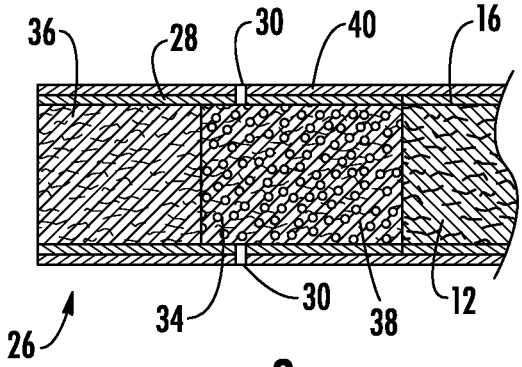
FIG. 3 is a cross-sectional view of a filter element incorporating an adsorbent material therein according to another embodiment of the present invention.

Thereafter, the treated adsorbent material can be used as an adsorbent in a filter element of a smoking article, such as a cigarette. The treated adsorbent can be incorporated into a filter element in any manner known in the art. For example, the adsorbent material can be incorporated within a filter element by incorporation within paper or other sheet-like material (e.g., as a longitudinally disposed segment of gathered, shredded, or otherwise configured paper-like material), within a segment of a cavity filter (e.g., a particles or granules within the central cavity region of a three segment or stage filter element such as shown in FIG. 2), or dispersed within a filter material (e.g., as particles or granules dispersed throughout a filter tow or gathered non-woven web material as shown in FIG. 3) as a segment of a longitudinally multi-segmented filter element. The adsorbent material can be dispersed in the wrapping materials enwrapping the filter element or the adsorbent material can be used in the form of filaments inserted or woven into a section of filter material.

The filter element of the invention incorporates an effective amount of the modified adsorbent material. The effective amount is an amount that, when incorporated into the filter element, provides some desired degree of alteration of the mainstream smoke of a cigarette incorporating that filter element. For example, a cigarette filter element incorporating adsorbent particles or granules according to the invention can act to lower the yield of certain gas phase components of the mainstream smoke passing through that filter element. Typically, the amount of adsorbent material within the filter element is at least about 20 mg, often at least about 30 mg, and frequently at least about 40 mg, on a dry weight basis. Typically, the amount of adsorbent material within the filter element does not exceed about 500 mg, generally does not exceed about 400 mg, often does not exceed about 300 mg, and frequently does not exceed about 200 mg, on a dry weight basis.

Filter elements incorporating the modified adsorbent of the invention can be used in a variety of smoking articles. Referring to FIG. 1, there is shown an exemplary smoking article 10 in the form of a cigarette and possessing certain representative components of a smoking article of the present invention. The cigarette 10 includes a generally cylindrical rod 12 of a charge or roll of smokable filler material contained in a circumscribing wrapping material 16. The rod 12 is conventionally referred to as a "tobacco rod." The ends of the tobacco rod 12 are open to expose the smokable filler material. The cigarette 10 is shown as having one optional band 22 (e.g., a printed coating including a film-forming agent, such as starch, ethylcellulose, or sodium alginate) applied to the wrapping material 16, and that band circumscribes the cigarette rod in a direction transverse to the longitudinal axis of the cigarette. That is, the band 22 provides a cross-directional region relative to the longitudinal axis of the cigarette. The band 22 can be printed on the inner surface of the wrapping material (i.e., facing the smokable filler material), or less preferably, on the outer surface of the wrapping material. Although the cigarette can possess a wrapping material having one optional band, the cigarette also can possess wrapping material having further optional spaced bands numbering two, three, or more.

At one end of the tobacco rod 12 is the lighting end 18, and at the mouth end 20 is positioned a filter element 26. The filter element 26 is positioned adjacent one end of the tobacco rod 12 such that the filter element and tobacco rod are axially aligned in an end-to-end relationship, preferably abutting one another. Filter element 26 may have a generally cylindrical shape, and the diameter thereof may be essentially equal to the diameter of the tobacco rod. The ends of the filter element 26 permit the passage of air and smoke therethrough. The filter element 26 is circumscribed along its outer circumference or longitudinal periphery by a layer of outer plug wrap 28.

A ventilated or air diluted smoking article can be provided with an optional air dilution means, such as a series of perforations 30, each of which extend through the tipping material 40 (as shown in FIG. 2) and plug wrap 28. The optional perforations 30 can be made by various techniques known to those of ordinary skill in the art, such as laser perforation techniques. Alternatively, so-called off-line air dilution techniques can be used (e.g., through the use of porous paper plug wrap and pre-perforated tipping paper).

As shown in FIG. 2, the filter element 26 is attached to the tobacco rod 12 using tipping material 40 (e.g., essentially air impermeable tipping paper), that circumscribes both the entire length of the filter element 26 and an adjacent region of the tobacco rod 12. The inner surface of the tipping material 40 is fixedly secured to the outer surface of the plug wrap 28 and the outer surface of the wrapping material 16 of the tobacco rod, using a suitable adhesive; and hence, the filter element and the tobacco rod are connected to one another.

The filter 26 includes a cavity 32 comprising a granular adsorbent 34. The cavity 32 is formed between two sections of filter material (e.g., two sections of plasticized cellulose acetate tow), a mouth-end segment 36 and a tobacco-end segment 38. Alternatively, instead of placement of the adsorbent in a cavity, the filter element 26 could include a tobacco-end segment of filter material 38 having the adsorbent 34 dispersed therein, as shown in FIG. 3.

During use, the smoker lights the lighting end 18 of the cigarette 10 using a match or cigarette lighter. As such, the smokable material 12 begins to burn. The mouth end 20 of the cigarette 10 is placed in the lips of the smoker. Thermal decomposition products (e.g., components of tobacco smoke) generated by the burning smokable material 12 are drawn through the tobacco rod 12, through the filter element 26, and into the mouth of the smoker. During draw, certain amount of certain gaseous components of the mainstream smoke are removed from the mainstream smoke or neutralized by the adsorbent material 34 within the filter element 26. Filters incorporating such adsorbent material 34 have the capability of capturing a wide range of mainstream tobacco smoke vapor phase components.

The dimensions of a representative cigarette 10 can vary. Preferred cigarettes are rod shaped, and can have a diameter of about 7.5 mm (e.g., a circumference of about 20 mm to about 27 mm, often about 22.5 mm to about 25 mm); and can have a total length of about 70 mm to about 120 mm, often about 80 mm to about 100 mm. The length of the filter element 26 can vary. Typical filter elements can have lengths of about 15 mm to about 65 mm, often about 20 mm to about 40 mm.

Representative filter materials can be manufactured from tow materials (e.g., cellulose acetate or polypropylene tow) or gathered web materials (e.g., gathered webs of paper, reconstituted tobacco, cellulose acetate, polypropylene or polyester). While the filter element of the invention includes one or more sections of plasticized fibrous tow material, additional filter segments comprising other filtration materials can also be present without departing from the invention. The number of filter segments within the filter element of the invention can vary. In certain embodiments, the filter element can include 2-5 sections of plasticized filter material.

Filter element components or segments for filter elements for multi-segment filtered cigarettes typically are provided from filter rods that are produced using traditional types of rod-forming units, such as those available as KDF-2 and KDF-3E from Hauni-Werke Korber & Co. KG. Typically, filter material, such as filter tow, is provided using a tow processing unit. An exemplary tow processing unit has been commercially available as E-60 supplied by Arjay Equipment Corp., Winston-Salem, N.C. Other exemplary tow processing units have been commercially available as AF-2, AF-3, and AF-4 from Hauni-Werke Korber & Co. KG. In addition, representative manners and methods for operating a filter material supply units and filter-making units are set forth in U.S. Pat. Nos. 4,281,671 to Byrne; 4,862,905 to Green, Jr. et al.; 5,060,664 to Siems et al.; 5,387,285 to Rivers; and 7,074,170 to Lanier, Jr. et al. Other types of technologies for supplying filter materials to a filter rod-forming unit are set forth in U.S. Pat. Nos. 4,807,809 to Pryor et al. and 5,025,814 to Raker; which are incorporated herein by reference.

Multi-segment filter rods can be employed for the production of filtered cigarettes possessing multi-segment filter elements. An example of a two-segment filter element is a filter element possessing a first cylindrical segment incorporating activated charcoal particles dispersed within or throughout cellulose acetate tow (e.g., a "dalmation" type of filter segment) at one end, and a second cylindrical segment that is produced from a filter rod produced essentially of plasticized cellulose acetate tow filter material at the other end. Filter elements also can have the form of so-called "patch filters" and possess segments incorporating carbonaceous materials. Representative types of filter designs and components, including representative types of segmented cigarette filters, are set forth in U.S. Pat. Nos. 4,920,990 to Lawrence et al.; 5,012,829 to Thesing et al.; 5,025,814 to Raker; 5,074,320 to Jones et al.; 5,105,838 to White et al.; 5,271,419 to Arzonico et al.; 5,360,023 to Blakley et al.; 5,396,909 to Gentry et al.; and 5,718,250 to Banerjee et al; US Pat. Appl. Pub. Nos. 2002/0166563 to Jupe et al., 2004/0261807 to Dube et al.; 2005/0066981 to Crooks et al.; 2006/0090769 to Woodson; 2006/0124142 to Zhang et al.; 2006/0144412 to Mishra et al., 2006/0157070 to Belcastro et al.; and 2007/0056600 to Coleman, III et al.; PCT WO03/009711 to Kim; and PCT WO03/047836 to Xue et al., which are incorporated herein by reference.

Multi-segment filter elements typically are provided from so-called "six-up" filter rods, "four-up" filter rods and "two-up" filter rods that are of the general format and configuration conventionally used for the manufacture of filtered cigarettes can be handled using conventional-type or suitably modified cigarette rod handling devices, such as tipping devices available as Lab MAX, MAX, MAX S or MAX 80 from Hauni-Werke Korber & Co. KG. See, for example, the types of devices set forth in U.S. Pat. Nos. 3,308,600 to Erdmann et al.; 4,281,670 to Heitmann et al.; 4,280,187 to Reuland et al.; 4,850,301 to Greene, Jr. et al.; and 6,229,115 to Vos et al.; and US Pat. Appl. Pub. Nos. 2005/0103355 to Holmes, 2005/1094014 to Read, Jr., and 2006/0169295 to Draghetti, each of which is incorporated herein by reference.

Filter elements of the present invention can be incorporated within the types of cigarettes set forth in U.S. Pat. Nos. 4,756,318 to Clearman et al.; 4,714,082 to Banerjea et al.; 4,771,795 to White et al.; 4,793,365 to Sensabaugh et al.; 4,989,619 to Clearman et al.; 4,917,128 to Clearman et al.; 4,961,438 to Korte; 4,966,171 to Serrano et al.; 4,969,476 to Bale et al.; 4,991,606 to Serrano et al.; 5,020,548 to Farrier et al.; 5,027,836 to Shannon et al.; 5,033,483 to Clearman et al.; 5,040,551 to Schlatter et al.; 5,050,621 to Creighton et al.; 5,052,413 to Baker et al.; 5,065,776 to Lawson; 5,076,296 to Nystrom et al.; 5,076,297 to Farrier et al.; 5,099,861 to Clearman et al.; 5,105,835 to Drewett et al.; 5,105,837 to Barnes et al.; 5,115,820 to Hauser et al.; 5,148,821 to Best et al.; 5,159,940 to Hayward et al.; 5,178,167 to Riggs et al.; 5,183,062 to Clearman et al.; 5,211,684 to Shannon et al.; 5,240,014 to Deevi et al.; 5,240,016 to Nichols et al.; 5,345,955 to Clearman et al.; 5,396,911 to Casey, III et al.; 5,551,451 to Riggs et al.; 5,595,577 to Bensalem et al.; 5,727,571 to Meiring et al.; 5,819,751 to Barnes et al.; 6,089,857 to Matsuura et al.; 6,095,152 to Beven et al; and 6,578,584 Beven; and US Pat. Appl. Serial Nos. US 2007/0215167 to Crooks et al. and US 2008/00092912 to Robinson et al.; which are incorporated herein by reference. For example, filter elements of the present invention can be incorporated within the types of cigarettes that have been commercially marketed under the brand names "Premier" and "Eclipse" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000); which are incorporated herein by reference.

Cigarette rods typically are manufactured using a cigarette making machine, such as a conventional automated cigarette rod making machine. Exemplary cigarette rod making machines are of the type commercially available from Molins PLC or Hauni-Werke Korber & Co. KG. For example, cigarette rod making machines of the type known as MkX (commercially available from Molins PLC) or PROTOS (commercially available from Hauni-Werke Korber & Co. KG) can be employed. A description of a PROTOS cigarette making machine is provided in U.S. Pat. No. 4,474,190 to Brand, at col. 5, line 48 through col. 8, line 3, which is incorporated herein by reference. Types of equipment suitable for the manufacture of cigarettes also are set forth in U.S. Pat. Nos. 4,781,203 to La Hue; 4,844,100 to Holznagel; 5,131,416 to Gentry; 5,156,169 to Holmes et al.; 5,191,906 to Myracle, Jr. et al.; 6,647,870 to Blau et al.; 6,848,449 to Kitao et al.; and 6,904,917 to Kitao et al.; and U.S. Patent Application Publication Nos. 2003/0145866 to Hartman; 2004/0129281 to Hancock et al.; 2005/0039764 to Barnes et al.; and 2005/0076929 to Fitzgerald et al.; each of which is incorporated herein by reference.

The components and operation of conventional automated cigarette making machines will be readily apparent to those skilled in the art of cigarette making machinery design and operation. For example, descriptions of the components and operation of several types of chimneys, tobacco filler supply equipment, suction conveyor systems and garniture systems are set forth in U.S. Pat. Nos. 3,288,147 to Molins et al.; 3,915,176 to Heitmann et al.; 4,291,713 to Frank; 4,574,816 to Rudszinat; 4,736,754 to Heitmann et al.; 4,878,506 to Pinck et al.; 5,060,665 to Heitmann; 5,012,823 to Keritsis et al.; and 6,360,751 to Fagg et al.; and U.S. Patent Publication No. 2003/0136419 to Muller; each of which is incorporated herein by reference. The automated cigarette making machines of the type set forth herein provide a formed continuous cigarette rod or smokable rod that can be subdivided into formed smokable rods of desired lengths.

Various types of cigarette components, including tobacco types, tobacco blends, top dressing and casing materials, blend packing densities and types of paper wrapping materials for tobacco rods, can be employed. See, for example, the various representative types of cigarette components, as well as the various cigarette designs, formats, configurations and characteristics, that are set forth in Johnson, Development of Cigarette Components to Meet Industry Needs, 52$^{nd}$ T.S.R.C. (September, 1998); U.S. Pat. Nos. 5,101,839 to Jakob et al.; 5,159,944 to Arzonico et al.; 5,220,930 to Gentry and 6,779,530 to Kraker; U.S. Patent Publication Nos. 2005/0016556 to Ashcraft et al.; 2005/0066986 to Nestor et al.; 2005/0076929 to Fitzgerald et al.; and 2007/0056600 to Coleman, III et al; U.S. patent application Ser. Nos. 11/375,700, filed Mar. 14, 2006, to Thomas et al. and 11/408,625, filed Apr. 21, 2006, to Oglesby; each of which is incorporated herein by reference. See also the tipping materials and configurations set forth in U.S. Pat. Publication No. 2008/0029111 to Dube et al., which is incorporated by reference herein.

For cigarettes of the present invention that are air diluted or ventilated, the amount or degree of air dilution or ventilation can vary. Frequently, the amount of air dilution for an air diluted cigarette is greater than about 10 percent, generally greater than about 20 percent, often greater than about 30 percent, and sometimes greater than about 40 percent. Typically, the upper level for air dilution for an air diluted cigarette is less than about 80 percent, and often is less than about 70 percent. As used herein, the term "air dilution" is the ratio (expressed as a percentage) of the volume of air drawn through the air dilution means to the total volume and air and aerosol drawn through the cigarette and exiting the extreme mouth end portion of the cigarette.

Preferred cigarettes of the present invention exhibit desirable resistance to draw. For example, an exemplary cigarette exhibits a pressure drop of between about 50 and about 200 mm water pressure drop at 17.5 cc/sec. air flow. Preferred cigarettes exhibit pressure drop values of between about 60 mm and about 180, more preferably between about 70 mm to about 150 mm, water pressure drop at 17.5 cc/sec. air flow. Typically, pressure drop values of cigarettes are measured using a Filtrona Cigarette Test Station (CTS Series) available form Filtrona Instruments and Automation Ltd.

Cigarettes of the present invention, when smoked, yield an acceptable number of puffs. Such cigarettes normally provide more than about 6 puffs, and generally more than about 8 puffs, per cigarette, when machine smoked under FTC smoking conditions. Such cigarettes normally provide less than about 15 puffs, and generally less than about 12 puffs, per cigarette, when smoked under FTC smoking conditions. FTC smoking conditions consist of 35 ml puffs of 2 second duration separated by 58 seconds of smolder.

Cigarettes of the present invention, when smoked, yield mainstream aerosol. The amount of mainstream aerosol that is yielded per cigarette can vary. When smoked under FTC smoking conditions, an exemplary cigarette yields an amount of FTC "tar" that normally is at least about 1 mg, often is at least about 3 mg, and frequently is at least about 5 mg. When smoked under FTC smoking conditions, an exemplary cigarette yields an amount of FTC "tar" that normally does not exceed about 20 mg, often does not exceed about 15 mg, and frequently does not exceed about 12 mg.

In addition, while the modified adsorbent materials of the invention are described as useful in smoking article filters, the adsorbent materials of the invention could be used in other gas or liquid filtration applications without departing from the invention, such as water filtration, solvent extraction, HVAC filtration, gold recovery, and the like.

EXPERIMENTAL

The present invention is more fully illustrated by the following examples, which are set forth to illustrate the present invention and are not to be construed as limiting thereof.

Example 1

Granules of gamma alumina (Fisher Scientific) are ground in a mortar pestle and the −30+80 US mesh fraction is collected. The granules are washed with deionized water and dried overnight at 120° C. Next, about 15 g of cerium nitrate hexahydrate (Alfa Aesar) is dissolved in 15 ml of water and the resulting solution is added to 24 g of (−30+80) US mesh gamma alumina by homogeneous impregnation. The impregnated sample is dried overnight at 120° C. followed by calcination at 500° C. for two hours. The calcination process converts the cerium nitrate hexahydrate to cerium oxide, and is believed to irreversibly dehydrate the compound.

Table 1 shows the effect of cerium nitrate hexahydrate treatment on the BET surface area of alumina. A single treatment of alumina with cerium nitrate results in a 26.7% increase in BET surface area while average width of the pores decreased by 28.8%. It is believed that increase in surface area together with decrease in pore width will result in increased adsorption capacity.

TABLE 1

BET Analysis of Gamma Alumina Treated with Cerium Nitrate

| Properties | Alumina | Ceria-Coated Alumina | % Change |
|---|---|---|---|
| BET Surface Area, $m^2/g$ | 176 | 223 | 26.7 |
| Surface Area of Pores Between 20 Å and 500 Å, $m^2/g$ | 190 | 237 | 24.7 |
| Average pore width, Å | 80 | 57 | −28.8 |
| Total Pore Volume $cm^3/g$ | 0.35 | 0.32 | −8.6 |

Example 2

The effect of ceria-treated alumina on the removal efficiency of certain vapor phase compounds is determined by smoking a Kentucky Reference Cigarette (i.e, a 2R4F cigarette) under a 45/40/2 smoking regimen (i.e., a puff volume of 45 cc; a puff interval of 40 seconds; and a puff duration of 2 seconds) and passing the vapor phase of mainstream smoke through a bed containing about 25 mg of the modified alumina material of Example 1. For the control, the bed contains 25 mg of unmodified alumina. The vapor phase compounds are identified and quantified by GC/MS.

Use of the ceria-modified alumina results in about 29.9% less 2-methyl-1-propene as compared to the untreated control. The ceria-modified alumina also results in about 29.7% less butanal, about 19.3% less limonene, about 13.0% less styrene, about 12.9% less 1,2-propadiene, about 11.9% less 2-methylfuran, and about 10.3% less 1-methylpyrrole. Thus, treatment of the adsorbent material with a metal oxide can result in enhanced adsorption of a wide variety of gas phase molecules, including unsaturated organic molecules, heterocyclic molecules, carbonyl-containing molecules, and the like.

Many modifications and other embodiments of the invention will come to mind to one skilled in the art to which this invention pertains having the benefit of the teachings presented in the foregoing description; and it will be apparent to those skilled in the art that variations and modifications of the present invention can be made without departing from the scope or spirit of the invention. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A filter element adapted for use in a smoking article, comprising a porous metal oxide adsorbent material in granular form impregnated with at least about 2 weight percent of a cerium oxide based on the total weight of the impregnating metal oxide and the adsorbent material, the impregnated metal oxide adsorbent material having a total BET surface area of at least about 200 $m^2/g$, a total mesopore volume of at least about 0.1 cc/g and a volume percentage of total pores present as mesopores of at least 30% and less than 95%.

2. The filter element of claim 1, wherein the porous metal oxide adsorbent material comprises at least about 5 weight percent of the impregnating cerium oxide.

3. The filter element of claim 1, wherein the porous metal oxide adsorbent material comprises at least about 10 weight percent of the impregnating cerium oxide.

4. The filter element of claim 1, wherein the porous metal oxide adsorbent material comprises an amount of impregnating cerium oxide sufficient to increase the mesopore volume of the porous metal oxide adsorbent material by at least 25%.

5. The filter element of claim 1, further comprising at least one section of fibrous tow, wherein the porous metal oxide adsorbent material is dispersed within the section of fibrous tow.

6. The filter element of claim 1, further comprising a cavity formed between two sections of fibrous tow, wherein the porous metal oxide adsorbent material is positioned in the cavity.

7. The filter element of claim 1, wherein the porous metal oxide adsorbent is alumina or titania.

8. A smoking article comprising the filter element of claim 1.

9. A method of preparing a filter element for a smoking article, comprising:

(i) impregnating a porous metal oxide adsorbent material in granular form with a cerium oxide or cerium oxide precursor to form an impregnated adsorbent material, the impregnated adsorbent material comprising at least about 2 weight percent of the impregnating cerium oxide or cerium oxide precursor based on the total weight of the impregnating metal oxide or metal oxide precursor and the adsorbent material;

(ii) if step (i) results in impregnation with a cerium oxide precursor, calcining the impregnated adsorbent material for a time and at a temperature sufficient to convert the cerium oxide precursor to the corresponding cerium oxide in order to provide a porous metal oxide adsorbent material impregnated with cerium oxide; and (iii) incorporating the porous metal oxide adsorbent material impregnated with cerium oxide into a smoking article filter element, wherein the porous metal oxide adsorbent material impregnated with metal oxide has a total BET surface area of at least about 200 $m^2/g$, a total mesopore volume of at least about 0.1 cc/g and a volume percentage of total pores present as mesopores of at least 30% and less than 95%.

10. The method of claim 9, wherein said impregnating step comprises treating the porous metal oxide adsorbent material with a liquid composition comprising a liquid carrier and a cerium oxide or cerium oxide precursor.

11. The method of claim 10, wherein the liquid carrier is water.

12. The method of claim 9, wherein the cerium oxide precursor is in the form of a cerium salt or an organic cerium compound capable of thermal decomposition to form a cerium oxide.

13. The method of claim 9, wherein the porous metal oxide adsorbent material comprises at least about 5 weight percent of the impregnating cerium oxide.

14. The method of claim 9, wherein the porous metal oxide adsorbent material comprises at least about 10 weight percent of the impregnating cerium oxide.

15. The method of claim 9, wherein the porous metal oxide adsorbent material comprises an amount of impregnating cerium oxide sufficient to increase the mesopore volume of the adsorbent material by at least 25%.

16. The method of claim 9, wherein the porous metal oxide adsorbent is alumina or titania.

17. The method of claim 9, wherein the smoking article filter element comprises at least one section of fibrous tow, wherein the porous metal oxide adsorbent material impregnated with cerium oxide is dispersed within the section of fibrous tow.

18. The method of claim 9, wherein the smoking article filter element comprises a cavity formed between two sections of fibrous tow, wherein the porous metal oxide adsorbent material impregnated with cerium oxide is positioned in the cavity.

* * * * *